US011721940B2

(12) United States Patent
Nakagawa

(10) Patent No.: US 11,721,940 B2
(45) Date of Patent: Aug. 8, 2023

(54) COAXIAL CONNECTOR WITH PARTITION

(71) Applicant: I-PEX Inc., Kyoto (JP)

(72) Inventor: Yuta Nakagawa, Machida (JP)

( * ) Notice: Subject to any disclaimer, the term of this patent is extended or adjusted under 35 U.S.C. 154(b) by 197 days.

(21) Appl. No.: 17/237,059

(22) Filed: Apr. 22, 2021

(65) Prior Publication Data

US 2021/0242631 A1 Aug. 5, 2021

Related U.S. Application Data

(63) Continuation of application No. PCT/JP2019/041572, filed on Oct. 23, 2019.

(30) Foreign Application Priority Data

Oct. 26, 2018 (JP) ..... 2018-201508

(51) Int. Cl.

| | |
|---|---|
| ***H01R 13/648*** | (2006.01) |
| ***H01R 13/6585*** | (2011.01) |
| ***H01R 9/05*** | (2006.01) |
| ***H01R 12/52*** | (2011.01) |
| ***H01R 24/50*** | (2011.01) |

(52) U.S. Cl.

CPC ..... *H01R 13/6585* (2013.01); *H01R 9/05* (2013.01); *H01R 12/52* (2013.01); *H01R 24/50* (2013.01)

(58) Field of Classification Search

CPC .. H01R 13/6581; H01R 13/6585; H01R 9/05; H01R 9/0503; H01R 12/52; H01R 24/38; H01R 24/50

USPC ..... 439/607.05

See application file for complete search history.

(56) References Cited

U.S. PATENT DOCUMENTS

| | | | | |
|---|---|---|---|---|
| 5,102,353 | A | 4/1992 | Brunker et al. | |
| 2010/0304589 | A1 | 12/2010 | Tuin et al. | |
| 2012/0108103 | A1 | 5/2012 | Ootani et al. | |
| 2015/0311619 | A1 | 10/2015 | Kato | |
| 2015/0357729 | A1 | 12/2015 | Uratani et al. | |
| 2019/0280409 | A1 | 9/2019 | Hoshiba et al. | |
| 2021/0242631 | A1* | 8/2021 | Nakagawa | H01R 12/57 |
| 2021/0265790 | A1* | 8/2021 | Nakagawa | H01R 13/40 |

FOREIGN PATENT DOCUMENTS

| | | |
|---|---|---|
| CN | 101901976 | 12/2010 |
| CN | 102468550 | 5/2012 |
| JP | H6-052936 | 2/1994 |

(Continued)

OTHER PUBLICATIONS

International Search Report dated Mar. 12, 2019 for PCT/JP2019/041569.

(Continued)

*Primary Examiner* — Khiem M Nguyen
(74) *Attorney, Agent, or Firm* — Soei Patent & Law Firm

(57) ABSTRACT

A coaxial connector device includes a first signal contact member joined to a central conductor of a first coaxial cable, a second signal contact member joined to a central conductor of a second coaxial cable, a ground contact member has an annular fitting portion arranged around the first and second signal contact members and is joined to the outer conductors of the respective first and second coaxial cables, and a flat partition provided with a ground potential and located between the first signal contact member and the second signal contact member.

18 Claims, 16 Drawing Sheets

(56) References Cited

FOREIGN PATENT DOCUMENTS

| | | |
|---|---|---|
| JP | H8-241762 | 9/1996 |
| JP | 2003-297502 | 10/2003 |
| JP | 2010-278007 | 12/2010 |
| JP | 2012-099299 | 5/2012 |
| JP | 2016-012553 | 1/2016 |
| JP | 2016-100190 | 5/2016 |
| JP | 2018-116925 | 7/2018 |
| WO | 2014/084293 | 6/2014 |

OTHER PUBLICATIONS

International Search Report dated Mar. 12, 2019 for PCT/JP2019/041572.
International Preliminary Report on Patentability with Written Opinion dated May 6, 2021 for PCT/JP2019/041569.
International Preliminary Report on Patentability with Written Opinion dated May 6, 2021 for PCT/JP2019/041572.
Soei Patent and Law Firm, Statement of Related Matters, dated Jun. 8, 2021.

* cited by examiner

COAXIAL CONNECTOR WITH PARTITION

CROSS-REFERENCE TO RELATED APPLICATIONS

This application is a continuation application of PCT Application No. PCT/JP2019/041572, filed on Oct. 23, 2019, which claims the benefit of priority from Japanese Patent Application No. 2018-201508, filed on Oct. 26, 2018, the entire contents of which are incorporated herein by reference.

BACKGROUND

1. Field

The present disclosure relates to a coaxial connector device in which a plurality of coaxial cables are connected. The coaxial connector device to which the plurality of coaxial cables are connected is fitted and connected to a mate coaxial connector device attached to the circuit board to electrically connect the plurality of coaxial cables to the circuit board.

2. Description of the Related Art

For transmission of a radio frequency signal between a plurality of electric components, electric devices, electronic apparatuses, or the like, a coaxial cable is used in many cases, in which a central conductor and an outer conductor surrounding the central conductor via an inner insulating member are covered with an outer insulating sheath to form a signal transmission route that is not easily affected by external noise. For example, a coaxial cable is connected to a circuit board handling a radio frequency signal, and the radio frequency signal is transmitted from the circuit board to the outside through the coaxial cable, or the radio frequency signal is transmitted from the outside to the circuit board through the coaxial cable.

When the coaxial cable is connected to the circuit board, for example, a cable side coaxial connector device is attached to one end of the coaxial cable, and the cable side coaxial connector device is fitted and connected to a board side coaxial connector device attached to the circuit board. The cable side coaxial connector device includes a signal contact to which the central conductor of the coaxial cable is joined and a ground contact to which the outer conductor of the coaxial cable is joined. The board side coaxial connector device includes a signal connection contact through which a radio frequency signal handled in the circuit board is provided, and an annular ground connection contact which is disposed to surround the signal connection contact and is provided with a ground potential. In the fitting and connecting of the cable side coaxial connector device to the board side coaxial connector device, for example, the ground contact of the cable side coaxial connector device is fitted and connected to the annular ground connection contact of the board side coaxial connector device, and the signal contact of the cable side coaxial connector device is connected to the signal connection contact of the board side coaxial connector device.

When the cable side coaxial connector device is fitted and connected to the board side coaxial connector device, the board side coaxial connector device attached to the parts mount surface of the circuit board is configured to direct, for example, the signal connection contact and the annular ground connection contact above the parts mount surface of the circuit board. For the board side coaxial connector device, the cable side coaxial connector device mounted at one end of the coaxial cable is engaged with the board side coaxial connector device along a direction from above the parts mount surface to the parts mount surface in the circuit board, so that the ground contact of the cable side coaxial connector device is fitted and connected to the annular ground connection contact of the board side coaxial connector device, and the signal contact of the cable side coaxial connector device is connected to the signal connection contact of the board side coaxial connector device.

As described above, when a coaxial cable is connected to a circuit board using a cable side coaxial connector device and a board side coaxial connector device, it is often necessary to connect a plurality of coaxial cables to the circuit board. In such a case, it is desired that each of the plurality of coaxial cables is reliably connected to the circuit board while limiting as much as possible the area occupied by the connector device required for connecting the plurality of coaxial cables to the circuit board in the parts mount surface of the circuit board.

Therefore, in the related art, a configuration has been proposed to which a cable side coaxial connector device is configured so that two coaxial cables are connected, and accordingly, a board side coaxial connector device to which the cable side coaxial connector device is fitted is configured so as to correspond to the cable side coaxial connector device to which the two coaxial cables are connected, thereby reducing an area occupied by the board side coaxial connector device and the cable side coaxial connector device in a parts mount surface of a circuit board to which the board side coaxial connector device is attached (for example, see Japanese Unexamined Patent Application Publication No. 2016-12553).

In a cable side coaxial connector device (female connector (10A) to which two coaxial cables are connected) disclosed in Japanese Unexamined Patent Application Publication No. 2016-12553, a first signal contact (signal terminal (14a)) to which a central conductor (inner conductor) of a first coaxial cable is jointed and a second signal contact (signal terminal (14c)) to which a central conductor (inner conductor) of a second coaxial cable is jointed are supported and disposed close to each other with a small gap therebetween by a common insulating housing (insulating member (16)). A ground contact (lower part 20 of the fixed terminal 12) common to the first signal contact and the second signal contact is disposed around the insulating housing supporting the first signal contact and the second signal contact. In the cable side coaxial connector device having such a configuration, it is expected that the first signal contact and the second signal contact are disposed close to each other with a small gap and the common ground contact is provided therebetween, thereby reducing the area occupied by the cable side coaxial connector device on the circuit board.

SUMMARY

In the cable side coaxial connector device proposed in the related art, the first signal contact to which the central conductor of the first coaxial cable is joined and the second signal contact to which the central conductor (inner conductor) of the second coaxial cable is joined are supported and disposed close to each other with a small gap by the common insulating housing. In this cable side coaxial connector device, the first signal contact and the second signal contact are disposed close to each other with the small gap. As a result, transmission characteristics of the radio frequency signal transmitted through the first signal contact and the radio frequency signal transmitted through the second signal contact may be deteriorated. That is, for example, there is a possibility of causing a crosstalk failure in which the radio frequency signal transmitted through the first signal contact is mixed as crosstalk noise into the radio frequency signal transmitted through the second signal contact, and the radio frequency signal transmitted through the second signal contact is mixed as crosstalk noise into the radio frequency signal transmitted through the first signal contact.

In view of the above, the present disclosure provides a cable side coaxial connector device that is fitted and connected to a mate coaxial connector device which is board side coaxial connector device attached to a parts mount surface of a circuit board in a state in which two coaxial cables are connected to the coaxial connector device, wherein an area occupied by the coaxial connector device in the parts mount surface of the circuit board can be reduced, and transmission characteristics of a radio frequency signal transmitted through the coaxial connector device can be prevented from deteriorating.

Disclosed herein is an example coaxial connector device. The coaxial connector device may include a first signal contact member to which a central conductor of a first coaxial cable is electrically connected configured to come into contact with and be connected to a first signal contact member of a mate coaxial connector device; and a second signal contact member to which a central conductor of a second coaxial cable is electrically connected configured to come into contact with and be connected to a second signal contact member of the mate coaxial connector device. The coaxial connector device may further include a ground contact member. The ground contact member may include: an annular fitting portion disposed around the first and second signal contact members to fit a mate ground contact member of the mate coaxial connector device; and a shell portion extending bendably from the annular fitting portion to be electrically connected to an outer conductor of each of the first and second coaxial cables. The coaxial connector device may further include an insulating housing supporting the first signal contact member, the second signal contact member, and the ground contact member in an isolated state; and a flat partition provided with a ground potential, held by the insulating housing and located between the first signal contact member and the second signal contact member.

Additionally, another example connector is disclosed herein. The connector is a connector for connecting a first cable and a second cable to a mate connector having a mate first signal contact, a mate second signal contact, and a mate conductive surrounding portion surrounding at least a portion of the mate first signal contact and at least a portion of the mate second signal contact. The connector may include: a first signal contact configured to be joined to a first signal conductor of the first cable and be in contact with the mate first signal contact to transmit a first signal; and a second signal contact configured to be joined to a second signal conductor of the second cable and be in contact with the mate second signal contact to transmit a second signal. The connector may further include a conductive surrounding portion surrounding at least a portion of the first signal contact and at least a portion of the second signal contact. The conductive surrounding portion may be configured to fit into the mate conductive surrounding portion. The connector may further include a conductive partition electrically connected to the conductive surrounding portion and partitioning an inner area of the conductive surrounding portion into a first region in which at least a portion of the first signal contact is disposed and a second region in which at least a portion of the second signal contact is disposed. The connector may be configured to transmit only one signal in the first region at any point in time, including the first signal. The connector may be configured to transmit only one signal in the second region at any point in time, including the second signal.

According to the coaxial connector device of the present disclosure, the first signal contact member and the second signal contact member disposed inside the annular fitting portion of the ground contact member are disposed close to each other with a small gap. Accordingly, an area occupied by the coaxial connector device in a parts mount surface of a circuit board to which a mate coaxial connector device corresponding to the coaxial connector device according to the present disclosure is attached may be reduced. Further, since the flat partition provided with the ground potential is disposed in the small gap between the first signal contact member and the second signal contact member, the first signal contact member and the second signal contact member are electromagnetically shielded from each other by the flat partition provided with the ground potential. Accordingly, the radio frequency signal transmitted through the first signal contact member is less likely to be mixed as crosstalk noise into the radio frequency signal transmitted through the second signal contact member, and the radio frequency signal transmitted through the second signal contact member is less likely to be mixed as crosstalk noise into the radio frequency signal transmitted through the first signal contact member. As a result, it is possible to suppress deterioration of the transmission characteristics of the radio frequency signal transmitted through each of the first signal contact member and the second signal contact member.

In addition, in the coaxial connector device according to the present disclosure, when the flat partition is integrally formed with the ground contact member so as to extend from a portion of the annular fitting portion of the ground contact member, the number of components can be reduced, the structure can be simplified, and the flat partition can be firmly disposed in the insulating housing.

DETAILED DESCRIPTION

Figure 1:
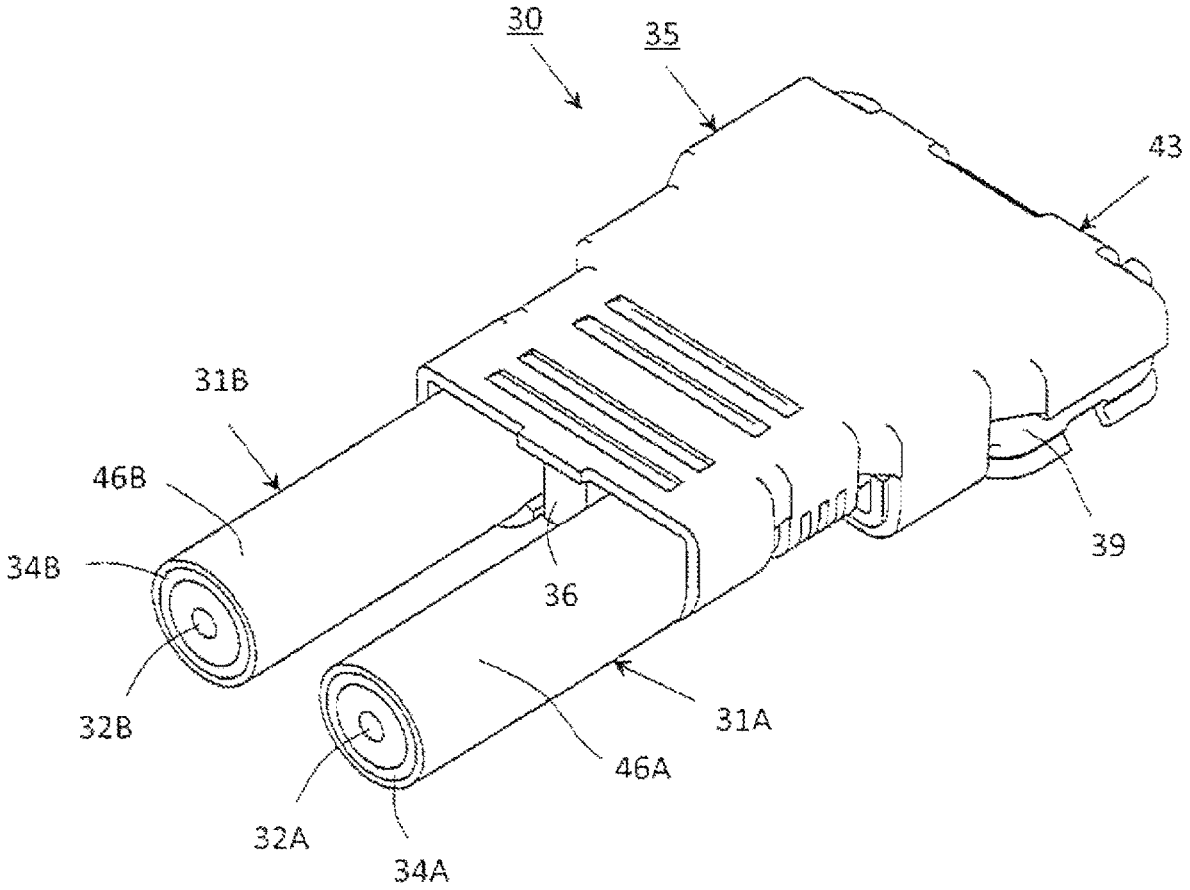
FIG. 1 is a top down perspective view of an example of a coaxial connector device with first and second coaxial cables connected thereto.

Hereinafter, with reference to the drawings, the same elements or similar elements having the same function are denoted by the same reference numerals, and redundant description will be omitted.

Figure 2:
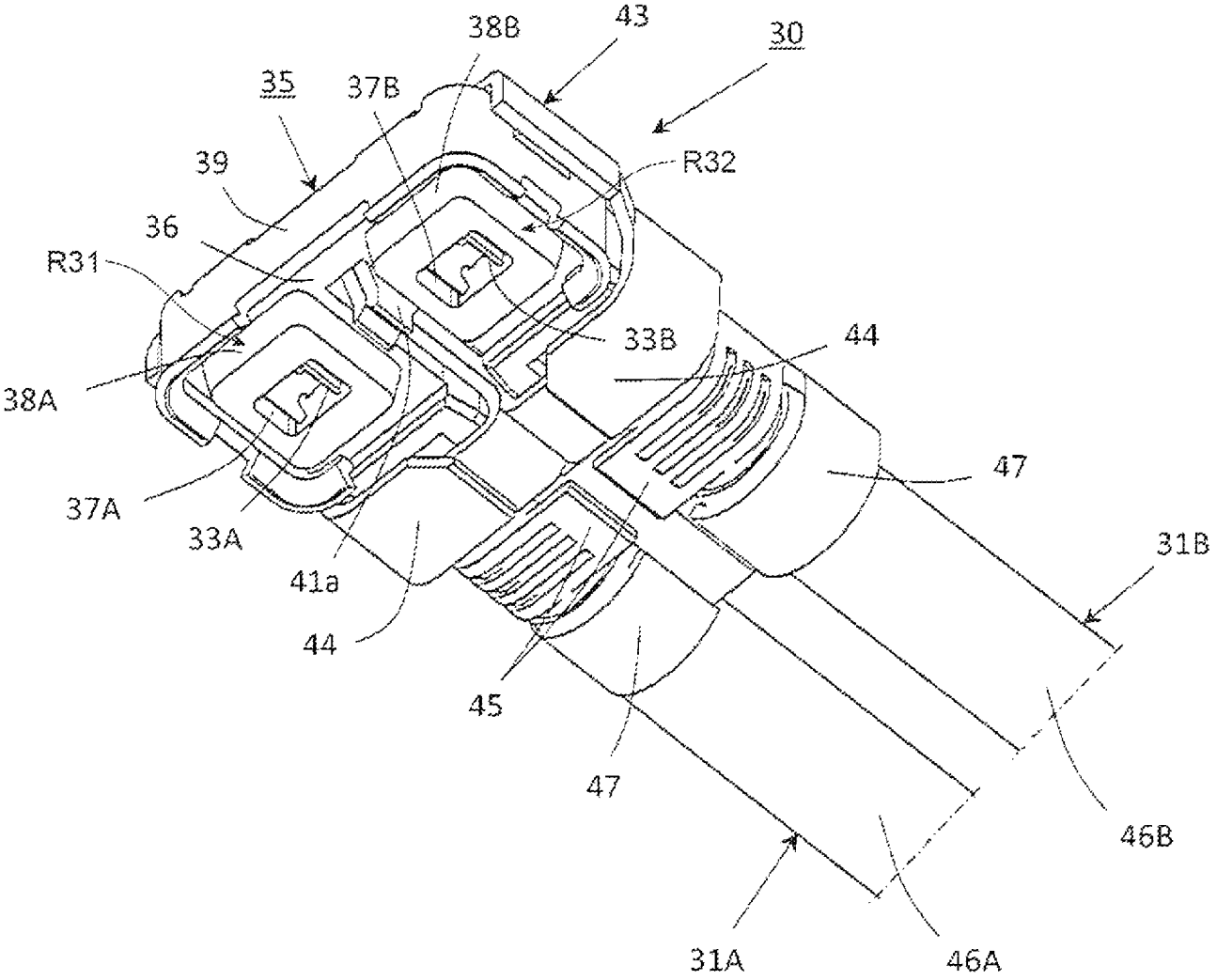
FIG. 2 is a perspective view looking up from below showing the example of the coaxial connector device with the first and second coaxial cables connected thereto.

FIGS. 1 and 2 show a coaxial connector device 30, which is an example of a coaxial connector device, with respective portions of a first coaxial cable 31A (a first cable) and a second coaxial cable 31B (a second cable) connected thereto.

As shown in FIGS. 1 and 2, the coaxial connector device 30 is used as a cable side coaxial connector device that is fitted and connected to a mate coaxial connector device which is a board side coaxial connector device attached to a parts mount surface of a circuit board in a state in which first and second coaxial cables 31A and 31B are connected to the coaxial connector device 30. For example, the coaxial connector device 30 is a connector for connecting the first and second coaxial cables 31A and 31B to a mate connector having a mate first signal contact, a mate second signal contact, and a mate conductive surrounding portion surrounding at least a portion of the mate first signal contact and at least a portion of the mate second signal contact.

The coaxial connector device 30 includes, as main elements, a first signal contact member 33A (a first signal contact), a second signal contact member 33B (a second signal contact), a ground contact member 35, and an insulating housing 36. The first coaxial cable 31A is a coaxial cable having a central conductor 32A (a first signal conductor) and an outer conductor 34A (a first outer conductor) surrounding the central conductor 32A. The second coaxial cable 31B is a coaxial cable having a central conductor 32B (a second signal conductor) and an outer conductor 34B (a second outer conductor) surrounding the central conductor 32B. The first coaxial cable 31A may further have an insulating sheath 46A (an insulating first sheath) surrounding the outer conductor 34A. The second coaxial cable 31B may further have an insulating sheath 46B (an insulating second sheath) surrounding the outer conductor 34A. The first signal contact member 33A is formed of a conductive material. The first signal contact member 33A is electrically connected to a central conductor 32A of the first coaxial cable 31A. The first signal contact member 33A is configured to be joined to the central conductor 32A of the first coaxial cable 31A and be in contact with the mate first signal contact to transmit a first signal. The second signal contact member 33B is formed of a conductive material. The second signal contact member 33B is electrically connected to a central conductor 32B of the second coaxial cable 31B. The second signal contact member 33B is configured to be joined to the central conductor 32B of the second coaxial cable 31B and be in contact with the mate second signal contact to transmit a second signal. The ground contact member 35 is formed of a conductive material. The ground contact member 35 is electrically connected to each of an outer conductor 34A of the first coaxial cable 31A and an outer conductor 34B of the second coaxial cable 31B to be provided with a ground potential. The insulating housing 36 is formed of an insulating material such as a synthetic resin, and supports the first signal contact member 33A, the second signal contact member 33B, and the ground contact member 35 in a state of being insulated from each other. The first coaxial cable 31A is connected to the coaxial connector device 30 such that its central conductor 32A is jointed to the first signal contact member 33A and its outer conductor 34A is jointed to the ground contact member 35. The second coaxial cable 31B is connected to the coaxial connector device 30 such that its central conductor 32B is jointed to the second signal contact member 33B and its outer conductor 34B is jointed to the ground contact member 35.

The insulating housing 36 has a first base 38A (a first insulating portion) and a second base 38B (a second insulating portion) adjacent to each other. A rectangular through hole 37A is formed at the center of the first base 38A. A rectangular through hole 37B is formed at the center of the second base 38B. The first base 38A holds the first signal contact member 33A, and the second base 38B holds the second signal contact member 33B. As a result, the first signal contact member 33A and the second signal contact members 33B are arranged so as to be close to each other with relatively small gap, that is, small gap.

The ground contact member 35 includes an annular fitting portion 39 (a conductive surrounding portion) that substantially surrounds the first base 38A and the second base 38B of the insulating housing 36. The annular fitting portion 39 is arranged around the first signal contact member 33A held by the first base 38A and the second signal contact member 33B held by the second base 38B. The first base 38A and the second base 38B of the insulating housing 36 and the annular fitting portion 39 of the ground contact member 35 constitute a fitting connect portion of the coaxial connector device 30. The coaxial connector device 30 to which the first coaxial cable 31A and the second coaxial cable 31B are connected is fitted and connected, by the fitting connect portion, to the mate coaxial connector device constituting the board side coaxial connector device. The annular fitting portion 39 surrounds at least a portion of the first signal contact member 33A and at least a portion of the second signal contact member 33B. The annular fitting portion 39 is configured to fit into the mate conductive surrounding portion.

Figure 4:
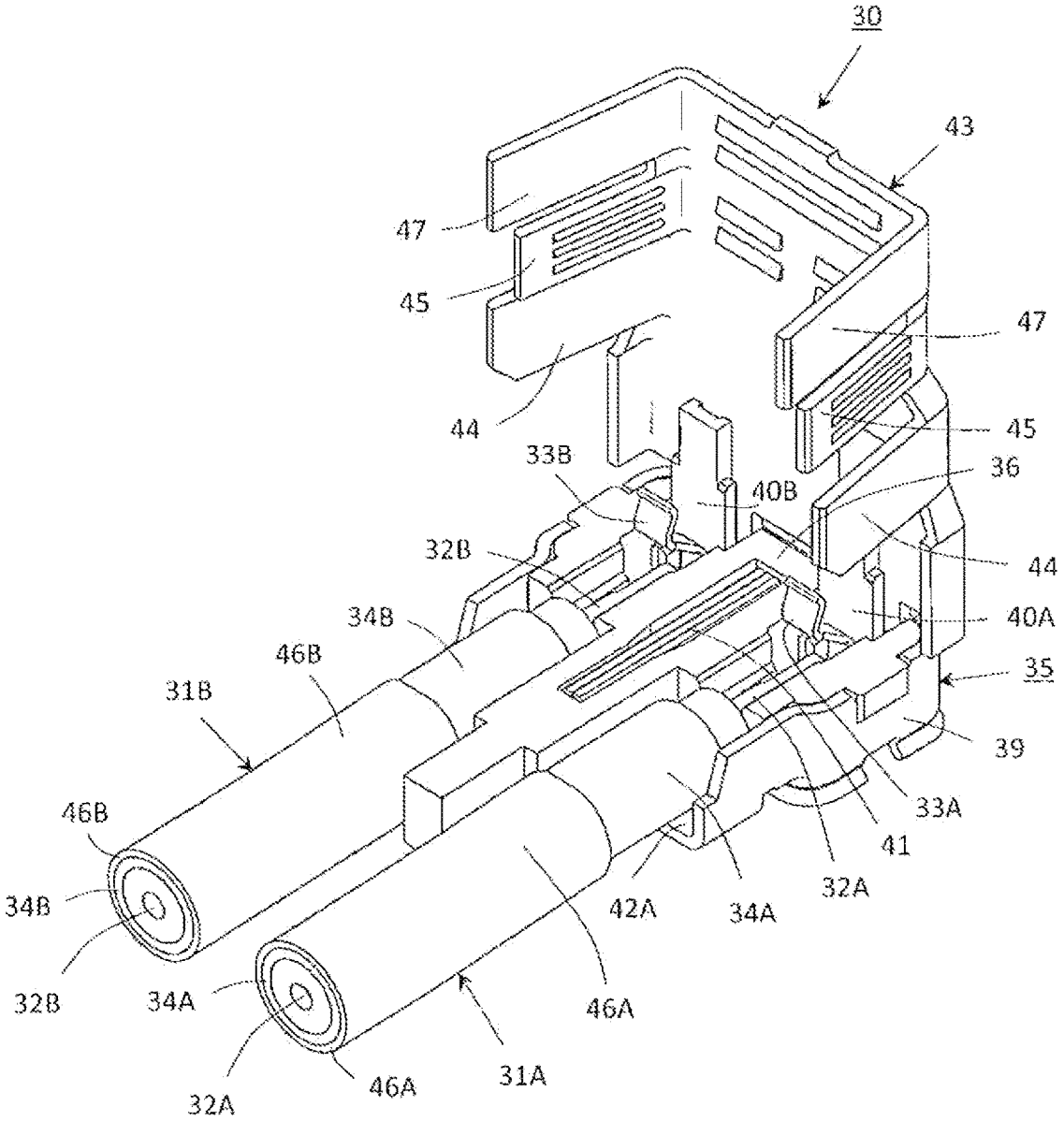
FIG. 4 is a perspective view illustrating a process of connecting the first and second coaxial cables to the example of the coaxial connector device.

As shown in FIG. 4 to be described later, the insulating housing 36 is provided with a bending contact portion 40A extending from one end of the first base 38A in a bendable manner and a bending contact portion 40B extending from one end of the third base 38B in a bendable manner, in addition to the first base 38A and the second base 38B. The bending contact portion 40A and the bending contact portion 40B each form a plate-shaped portion as a whole, and when bent, come into contact with the first signal contact member 33A and the second signal contact member 33B, respectively.

Figure 3:
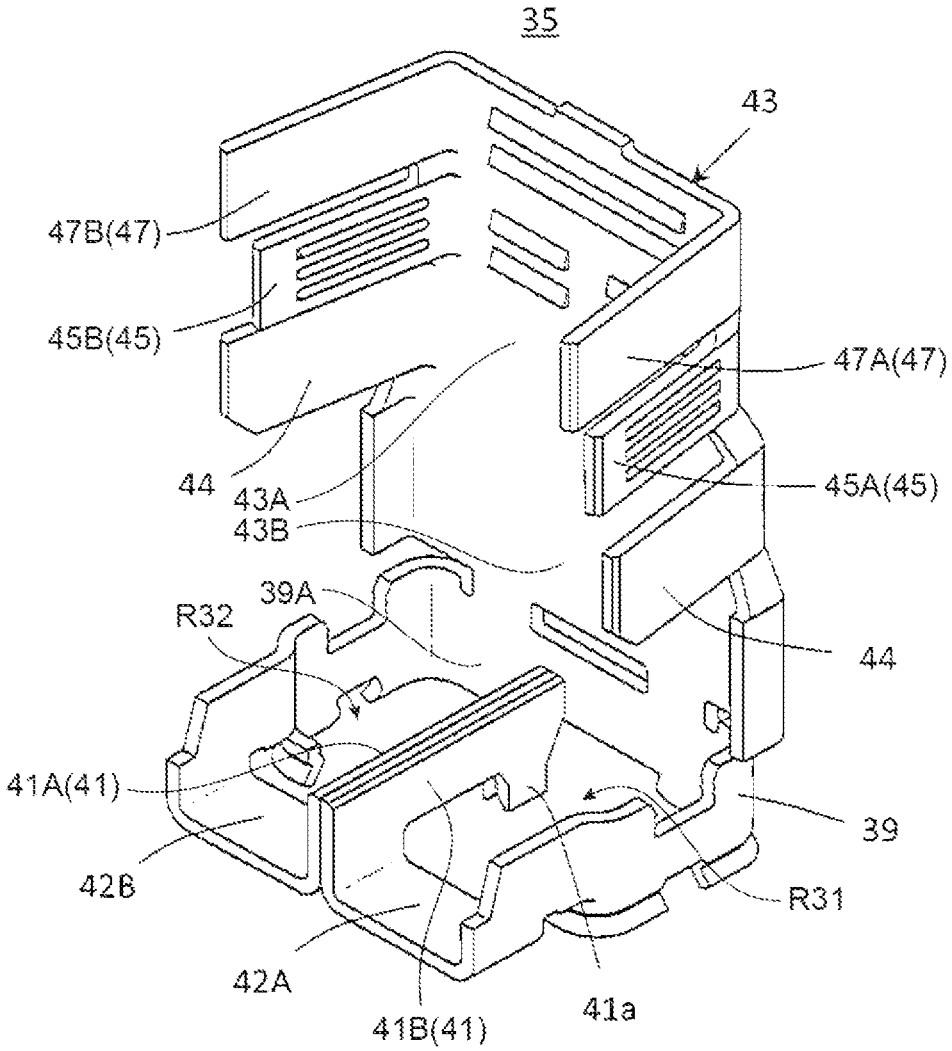
FIG. 3 is a perspective view showing a ground contact member included in the example of the coaxial connector device.

As shown in FIG. 3 illustrating ground contact member 35, the annular fitting portion 39 of the ground contact member 35 is provided with a flat partition 41 (a conductive partition). The flat partition 41 extends from a portion of the annular fitting portion 39 into an annulus formed by the annular fitting portion 39. Therefore, the flat partition 41 is integrally formed with the ground contact member 35. The flat partition 41 may be integrally formed with the annular fitting portion 39. The flat partition 41 is interposed between the first signal contact member 33A held by the first base 38A of the insulating housing 36 and the second signal contact member 33B held by the second base 38B of the insulating housing 36 under the condition that the ground contact member 35 is supported by the insulating housing 36. Therefore the flat partition 41 is provided in a small gap between the first signal contact member 33A and the second signal contact member 33B and partitions between the first signal contact member 33A and the second signal contact member 33B. The flat partition 41A is electrically connected to the annular fitting portion 39. The flat partition 41A partitions an inner area of the annular fitting portion 39 into a first region R31 and a second region R32. At least a portion of the first signal contact member 33A is disposed in the first region R31. At least a portion of the second signal contact member 33B is disposed in the region R32. In some examples, the coaxial connector device 30 is configured to transmit only one signal in the first region R31 at any point in time, including the first signal, and the coaxial connector device 30 is configured to transmit only one signal in the second region R32 at any point in time, including the second signal. In some examples, the first signal contact member 33A is the only signal contact located in the first region R31, and the second signal contact member 33B is the only signal contact located in the second region R32. The annular fitting portion 39 may include cable supports 42A and 42B (a first portion) and a wall 39A (a second portion). The cable supports 42A and 42B and the wall 39A may face with each other, and both the first region R31 and the second region R32 may be located between the cable supports 42A and 42B and the wall 39A. The flat partition 41A may extend from the cable supports 42A and 42B toward the wall 39A.

Thus, with the first coaxial cable 31A is connected to the coaxial connector device 30 so that the central conductor 32A is connected to the first signal contact member 33A and the outer conductor 34A is connected to the ground contact member 35, and with the second coaxial cable 31B is connected to the coaxial connector device 30 so that the central conductor 32B is connected to the second signal contact member 33B and the outer conductor 34B is connected to the ground contact member 35, the first signal contact member 33A to which the central conductor 32A of the first coaxial cable 31A is connected and the second signal contact member 33B to which the central conductor 32B of the second coaxial cable 31B is connected are partitioned by the flat partition 41. Since the flat partition 41 is provided with a ground potential through the annular fitting portion 39 of the ground contact member 35, the first signal contact member 33A and the second signal contact member 33B are electromagnetically shielded from each other by the flat partition 41 provided with the ground potential.

An engaging connect portion 41*a* is provided at one end of the flat partition 41. The engaging connect portion 41*a* is configured to be in contact with a ground contact member of the mate coaxial connector device when the coaxial connector device 30 is fitted and connected to the mate coaxial connector device. The flat partition 41 may penetrate the insulating housing 36. Since the engaging connect portion 41*a* of the flat partition 41 is in contact with the ground contact member of the mate coaxial connector device, the ground contact member 35 with which the flat partition 41 is provided and the ground contact member of the mate coaxial connector device are firmly connected to each other.

The annular fitting portion 39 of the ground contact member 35 is provided with a pair of cable supports 42A and 42B with the rising portion of the flat partition 41 therebetween. The cable support 42A supports the first coaxial cable 31A in which the central conductor 32A is connected to the first signal contact member 33A, and the cable support 42B supports the second coaxial cable 31B in which the central conductor 32B is connected to the second signal contact member 33B.

Figure 13:
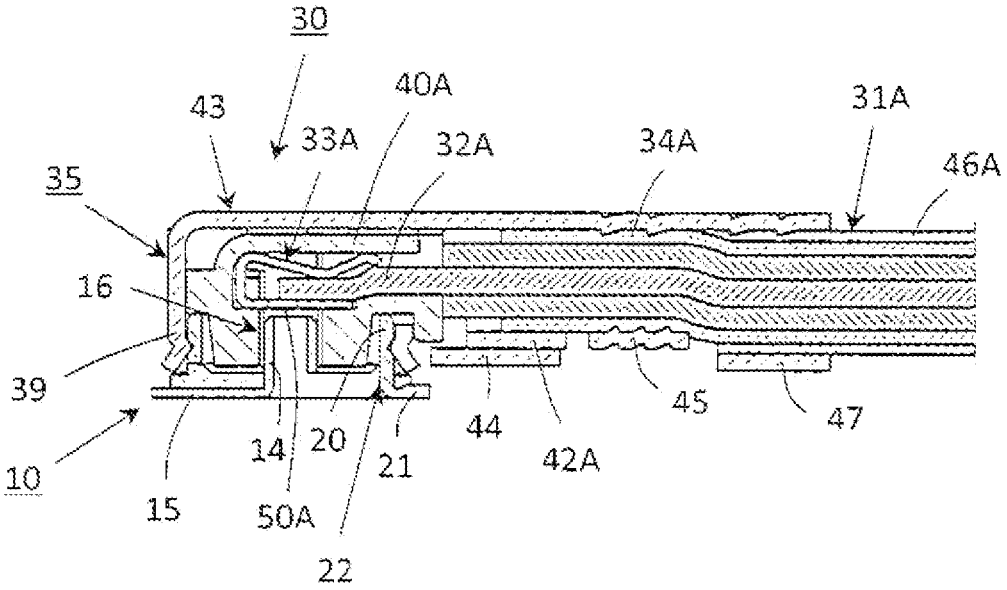
FIG. 13 is a sectional view taken along line XIII-XIII in FIG. 11.

Further, in addition to the annular fitting portion 39, the ground contact member 35 is provided with a shell portion 43 bendably extending from one end of the annular fitting portion 39. As shown in FIG. 13 described later, when the shell portion 43 is bent, the bending contact portions 40A and 40B of the insulating housing 36 are bent accordingly, and the shell portion 43 is connected to the outer conductor 34A of the first coaxial cable 31A in which the central conductor 32A is connected to the first signal contact member 33A and the outer conductor 34B of the second coaxial cable 31B in which the central conductor 32B is connected to the second signal contact member 33B. The shell portion 43 may be joined to the outer conductors 34A and 34B outside the annular fitting portion 39.

The shell portion 43 is provided with a pair of first bending engagement portions 44, a pair of second bending engagement portions 45, and a pair of third bending engagement portions 47. A pair of first bending engagement portions 44 are bent to engage with cable supports 42A and 42B, respectively. The pair of second bending engagement portions 45 are bent to engage with the outer conductor 34A of the first coaxial cable 31A in which the central conductor 32A is connected to the first signal contact member 33A and the outer conductor 34B of the second coaxial cable 31B in which the central conductor 32B is connected to the second signal contact member 33B, respectively. The pair of second bending engagement portions 45 includes a first outer conductor holder 45A and a second outer conductor holder 45B. The first outer conductor holder 45A is configured to be electrically joined to the exposed outer conductor 34A. The second outer conductor holder 45B is configured to be electrically joined to the exposed outer conductor 34B. The pair of third bending engagement portions 47 are bent to engage with the insulating sheath 46A of the first coaxial cable 31A in which the central conductor 32A is connected to the first signal contact member 33A and the insulating sheath 46B of the second coaxial cable 31B in which the central conductor 32B is connected to the second signal contact member 33B, respectively. The pair of third bending engagement portions 47 includes a first sheath holder 47A and a second sheath holder 47B. Accordingly, the first outer conductor holder 45A is located between the first sheath holder 47A ant the annular fitting portion 39. The second conductor holder 45B is located between the second sheath holder 47B. The shell portion 43 may further include a base portion 43A extending outward from the annular fitting portion 39. The first sheath holder 47A may be configured to hold the first coaxial cable 31A with the first coaxial cable 31A located between the first sheath holder 47A and the base portion 43A. The first conductor holder 45A may be configured to hold the first coaxial cable 31A with the first coaxial cable 31A located between the first conductor holder 45A and the base portion 43A. The second sheath holder 47B may be configured to hold the second coaxial cable 31B with the second coaxial cable 31B located between the second sheath holder 47A and the base portion 43A. The second conductor holder 45B may be configured to hold the second coaxial cable 31B with the second coaxial cable 31B located between the second conductor holder 45B and the base portion 43A. The shell portion 43 may further include a conductive cover 43B which closes one end of the annular fitting portion 39. The base portion 43A may be integrally formed with the conductive cover 43B. The annular fitting portion 39 may include a wall portion 39A and cable supports 42A and 42B (a facing portion). The wall portion 39A is substantially perpendicular to the conductive cover 43B. The cable supports 42A and 42B face the conductive cover 43B. Both the first region R31 and the second region R32 are located between the wall portion 39A and the cable supports 42A and 42B. The flat partition 41 may extend from the cable supports 42A and 42B toward the conductive cover 43B, and may extend from the cable supports 42A and 42B toward the wall portion 39A. The cable support 42A (a first facing portion) faces the conductive cover 43B via the first coaxial cable 31A. The cable support 42B (a second facing portion) faces the conductive cover 43B via the first coaxial cable 31B. The flat partition 41 may include a first partition 41A and a second partition 41B. The first partition 41A extends from the cable support 42A toward the conductive cover 43B, and extends from the cable support 42A toward the wall portion 39A. The second partition 41B extends from the cable support 42B toward the conductive cover 43B and extends from the cable support 42B toward the wall portion 39A. The second partition 41B may overlap the first partition 41A.

When the first coaxial cable 31A and the second coaxial cable 31B are connected to the coaxial connector device 30 including the insulating housing 36, the first signal contact member 33A, the second signal contact member 33B, and the ground contact member 35 as described above, first, as shown in FIG. 4, the first coaxial cable 31A and the second coaxial cable 31B are disposed on the coaxial connector device 30 in which the shell portion 43 provided on the ground contact member 35 is not bent. The first coaxial cable 31A is disposed such that the outer conductor 34A and the central conductor 32A are exposed at one end thereof, the exposed outer conductor 34A is in contact with the cable support 42A of the ground contact member 35, and the exposed central conductor 32A is in contact with the first signal contact member 33A of the coaxial connector device 30. In addition, the second coaxial cable 31B is disposed such that the outer conductor 34B and the central conductor 32B are exposed at one end thereof, the exposed outer conductor 34B is in contact with the cable support 42B of the ground contact member 35, and the exposed central conductor 32B is in contact with the second signal contact member 33B of the coaxial connector device 30.

Subsequently, the shell portion 43 of the ground contact member 35 is bent toward the annular fitting portion 39. As a result, the bending contact portion 40A of the insulating housing 36 is bent by the shell portion 43 and pressed against the first signal contact member 33A, so that the central conductor 32A of the first coaxial cable 31A is firmly connected to the first signal contact member 33A. At the same time, the bending contact portion 40B of the insulating housing 36 is bent by the shell portion 43 and pressed against the second signal contact member 33B, so that the central conductor 32B of the second coaxial cable 31B is firmly connected to the second signal contact member 33B. The bent shell portion 43 comes into contact with the outer conductor 34A of the first coaxial cable 31A being in contact with the cable support 42A provided in the annular fitting portion 39, and the first coaxial cable 31A having the outer conductor 34A is sandwiched between the shell portion 43 and the cable support 42A. At the same time, the shell portion 43 comes into contact with the outer conductor 34B of the second coaxial cable 31B being in contact with the cable support 42B provided in the annular fitting portion 39, and the second coaxial cable 31B having the outer conductor 34B is sandwiched between the shell portion 43 and the cable support 42B.

Thereafter, the first bending engagement portions 44 provided in the shell portion 43 are bent to be close to each other and are engaged with the cable supports 42A and 42B supporting the first coaxial cable 31A and the second coaxial cable 31B, respectively. In addition, the pair of second bending engagement portions 45 provided in the shell portion 43 are bent to be close to each other and are engaged with the outer conductor 34A of the first coaxial cable 31A in which the central conductor 32A is connected to the first signal contact member 33A, and the outer conductor 34B of the second coaxial cable 31B in which the central conductor 32B is connected to the second signal contact member 33B, respectively. Further, the pair of third bending engagement portions 47 provided in the shell portion 43 are bent to be close to each other, and are engaged with the insulating sheath 46A of the first coaxial cable 31A in which the central conductor 32A is connected to the first signal contact member 33A, and the insulating sheath 46B of the second coaxial cable 31B in which the central conductor 32B is connected to the second signal contact member 33B, respectively. Accordingly, the first coaxial cable 31A and the second coaxial cable 31B are firmly connected to the coaxial connector device 30, and as a result, the coaxial connector device 30 is in the state shown in FIGS. 1 and 2.

Figure 5:
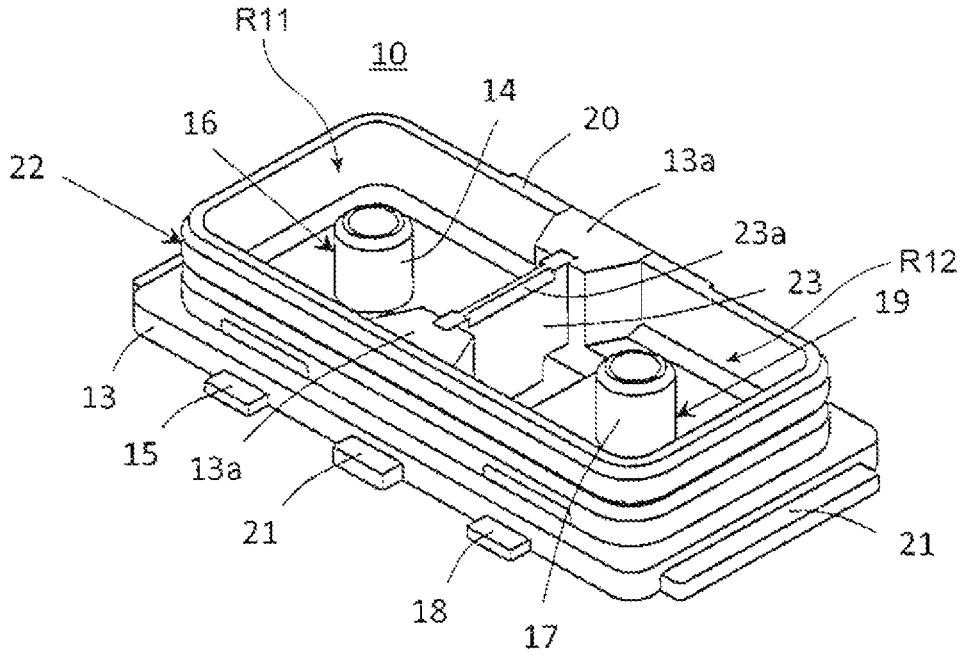
FIG. 5 is a top down perspective view of an example of a mate coaxial connector device to which the example of the coaxial connector device is fitted and connected.
Figure 6:
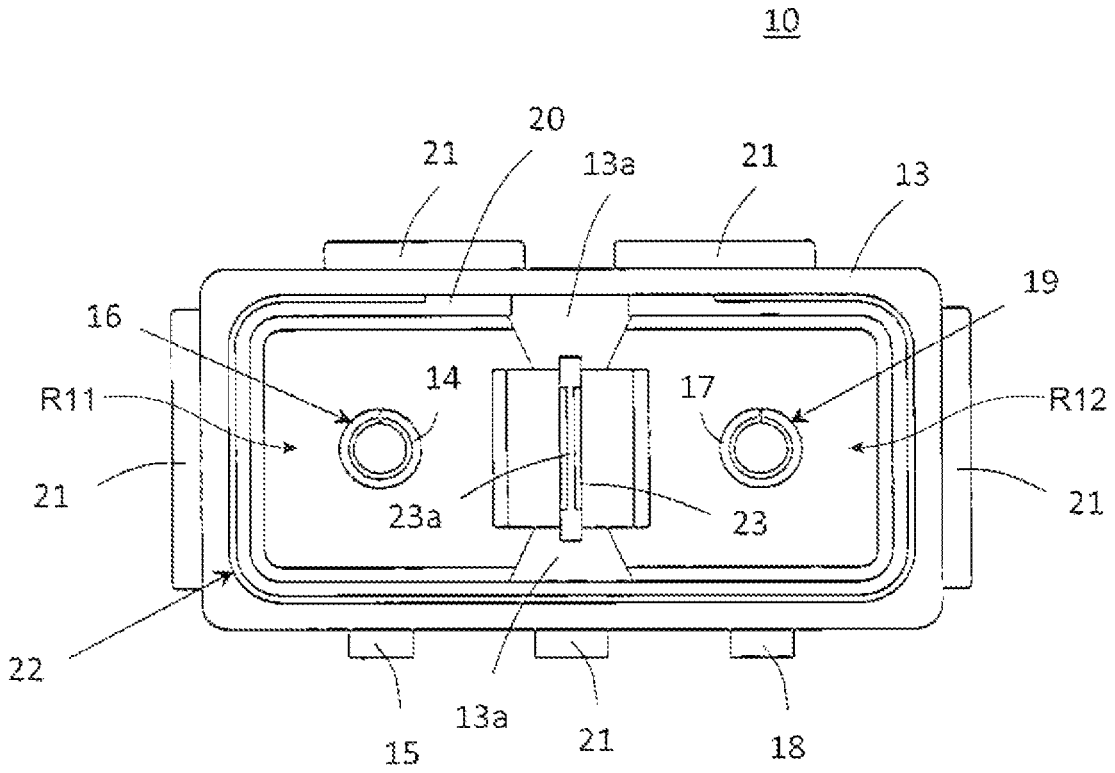
FIG. 6 is a plan view showing the example of the mate coaxial connector device to which the example of the coaxial connector device is fitted and connected.
Figure 7:
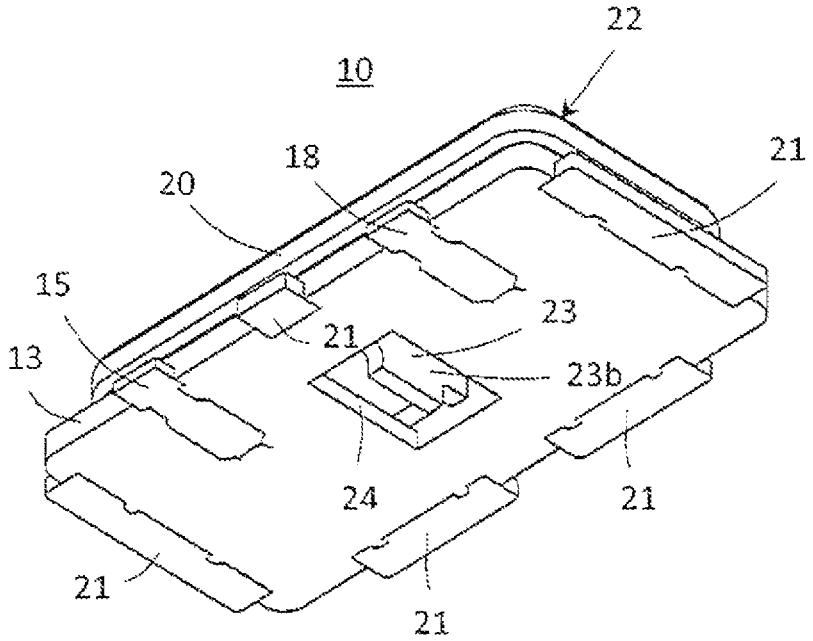
FIG. 7 is a perspective view looking up from below showing the example of the mate coaxial connector device to which the example of the coaxial connector device is fitted and connected.

FIGS. 5, 6 and 7 show a board side coaxial connector device 10 constituting an example of a mate coaxial connector device to which a coaxial connector device 30 constituting an example of the coaxial connector device is fitted and connected.

Figure 9:
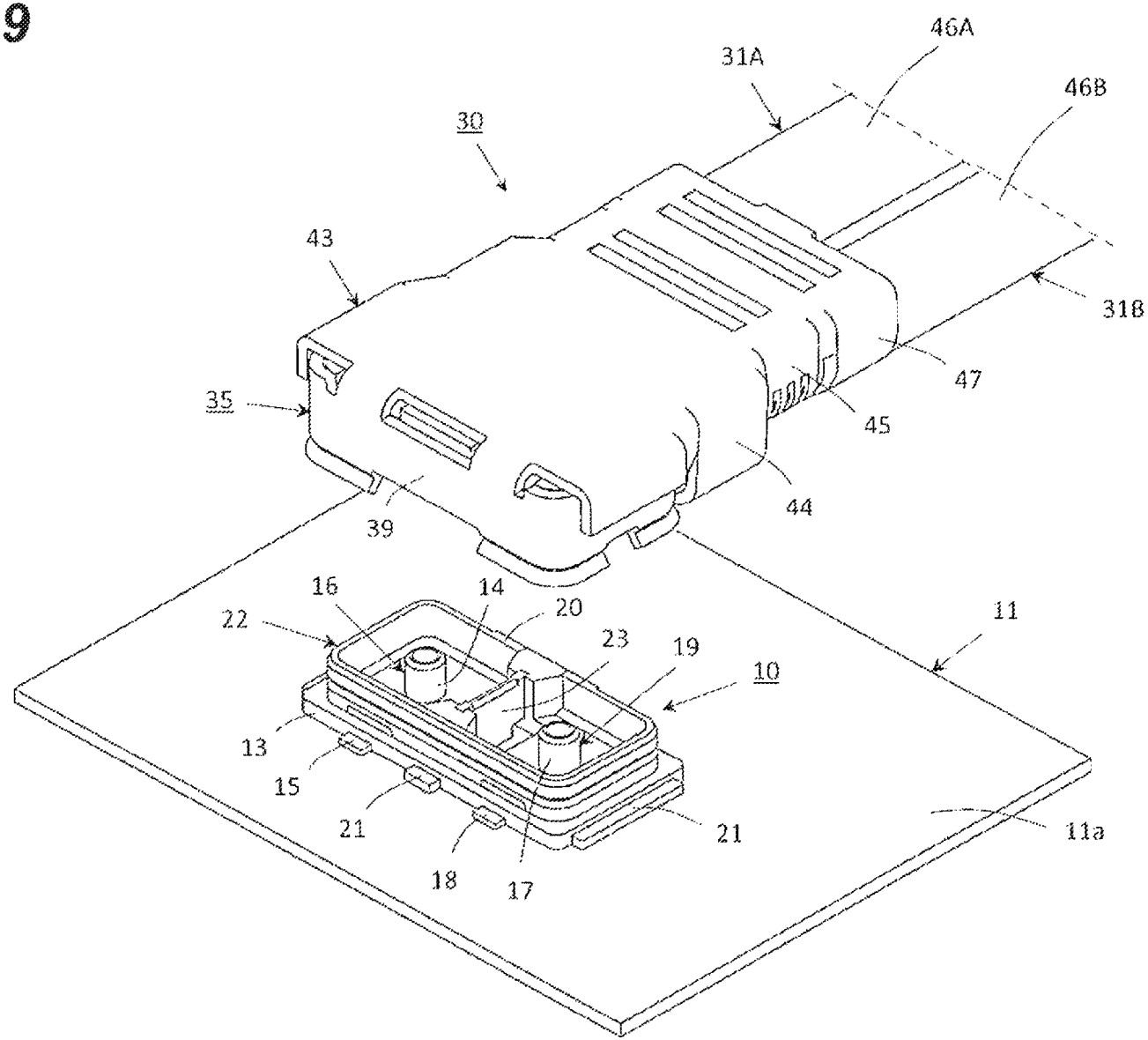
FIG. 9 is a perspective view showing a state in which the example of the coaxial connector device to which the plurality of coaxial cables are connected is arranged opposite to the example of the mate coaxial connector device attached to a circuit board.
Figure 10:
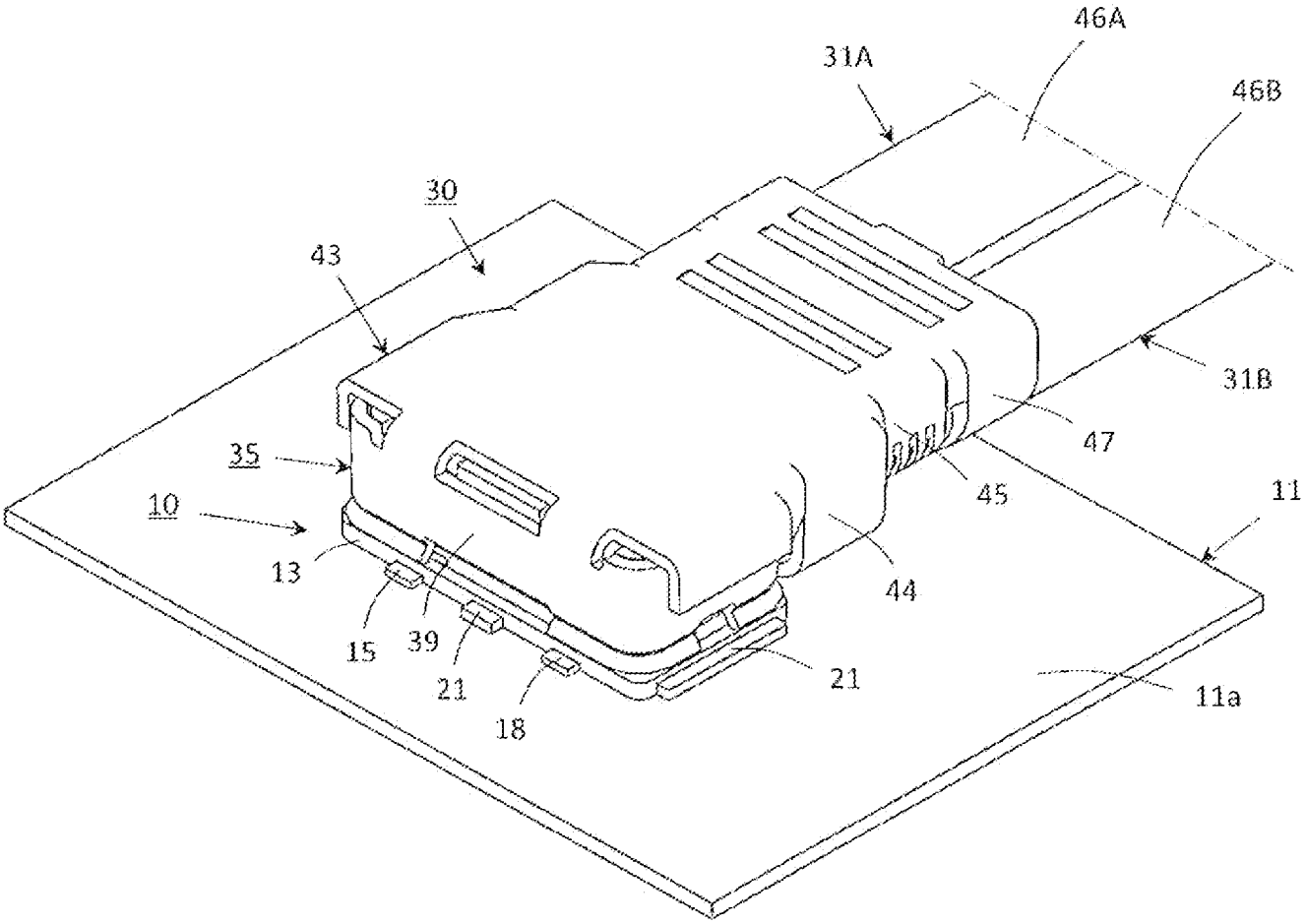
FIG. 10 is a perspective view showing the example of the coaxial connector device to which the plurality of coaxial cables are connected is fitted and connected to the example of the mate coaxial connector device attached to the circuit board.

To the board side coaxial connector device 10 shown in FIGS. 5, 6, and 7, a coaxial connector device 30 constituting an example of the coaxial connector device to which the first and second coaxial cables 31A and 31B are connected is fitted and connected. The board side coaxial connector device 10 is attached to the parts mount surface 11*a* of the circuit board 11, and is used in practice. Although the circuit board 11 is not shown in FIGS. 5, 6, and 7, the circuit board 11 is shown in FIGS. 9 and 10 described later.

The board side coaxial connector device 10 includes an insulating body 13, a first signal contact member 16 (a mate first signal contact), and a second signal contact member 19 (a mate second signal contact). The insulating body 13 is formed of an insulating material such as a synthetic resin into a flat plate shape, and is disposed on the parts mount surface 11*a* of the circuit board 11. The first signal contact member 16 is formed of a metal material and assembled to the insulating body 13. The first signal contact member 16 has a protruding contact portion 14 and a signal joint portion 15. The protruding contact portion 14 protrudes from the insulating body 13. The first signal contact member 33A connected to the central conductor 32A of the first coaxial cable 31A in the coaxial connector device 30 comes in contact with the protruding contact portion 14. The signal joint portion 15 extends from the protruding contact portion 14 to the outside of the insulating body 13. The signal joint portion 15 is jointed to a signal terminal disposed on the parts mount surface 11*a* of the circuit board 11. The second signal contact member 19 is also formed of a metal material and assembled to the insulating body 13. The second signal contact member 19 has a protruding contact portion 17 and a signal joint portion 18. The protruding contact portion 17 protrudes from the insulating body 13. The second signal contact member 33B connected to the central conductor 32B of the second coaxial cable 31B in the coaxial connector device 30 comes into contact with the protruding contact portion 17. The signal joint portion 18 extends from the protruding contact portion 17 to the outside of the insulating body 13. The signal joint portion 18 is jointed to a signal terminal portion disposed on the parts mount surface 11*a* of the circuit board 11. The protruding contact portion 14 of the first signal contact member 16 and the protruding contact portion 17 of the second signal contact member 19 are disposed on the insulating body 13 to face each other with a relatively small gap therebetween.

The board side coaxial connector device 10 also includes an annular contact portion 20 (a mate conductive surrounding portion), a ground contact member 22, and a conductive partition member 23 (a mate conductive partition). The annular contact portion 20 is formed of a metal material and assembled to the insulating body 13, and surrounds the protruding contact portion 14 of the first signal contact member 16 and the protruding contact portion 17 of the second signal contact member 19. The ground contact member 35 connected to the outer conductor 34A of the first coaxial cable 31A and the outer conductor 34B of the second coaxial cable 31B in the coaxial connector device 30 comes into contact with the annular contact portion 20. The ground contact member 22 extends from the annular contact portion 20 to the exterior of the insulating body 13. The ground contact member 22 has a ground joint portion 21 connected to a ground terminal disposed on the parts mount surface 11*a* of the circuit board 11. The conductive partition member 23 is supported by a pair of protruding supports 13*a* provided on the insulating body 13 and is interposed between the protruding contact portion 14 of the first signal contact member 16 and the protruding contact portion 17 of the second signal contact member 19. The conductive partition member 23 is provided with a ground potential. As such, the conductive partition member 23 is disposed within a small gap between the protruding contact portion 14 of the first signal contact member 16 and the protruding contact portion 17 of the second signal contact member 19 in the insulating body 13. The conductive partition member 23 partitions an inner area of the annular contact portion 20 into a mate first region R11 and a mate second region R12. At least a portion of the first signal contact member 16 is disposed in the mate first region R11. At least a portion of the second signal contact member 19 is disposed in the mate second region R12. When the annular fitting portion 39 is fitted to the annular contact portion 20, the first base 38A is disposed in the mate first region R11 and the second base 38B is disposed in the mate second region R12. Accordingly, the protruding contact portion 14 of the first signal contact member 16 and the protruding contact portion 17 of the second signal contact member 19 are electromagnetically shielded from each other by the conductive partition member 23 with which the ground potential is provided.

As described above, the board side coaxial connector device 10 includes the insulating body 13, the first signal contact member 16 having the protruding contact portion 14, the second signal contact member 19 having the protruding contact portion 17, and the conductive partition member 23 interposed between the protruding contact portion 14 of the first signal contact member 16 and the protruding contact portion 17 of the second signal contact member 19 and provided with a ground potential. In the insulating body 13, a portion of the annular contact portion 20 of the ground contact member 22 and the conductive partition member 23 form a first conductive wall surrounding the protruding contact portion 14 of the first signal contact member 16, and another portion of the annular contact portion 20 of the ground contact member 22 and the conductive partition member 23 form a second conductive wall surrounding the protruding contact portion 17 of the second signal contact member 19.

Figure 8:
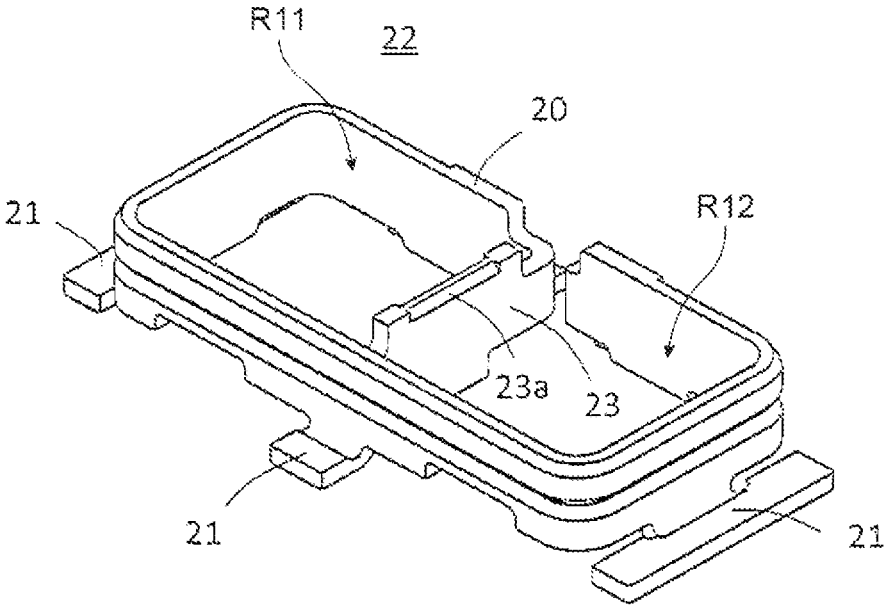
FIG. 8 is a perspective view illustrating a ground contact member included in an example of the mate coaxial connector device to which an example of the coaxial connector device is fitted and connected.

FIG. 8 shows a configuration example of the ground contact member 22. The ground contact member 22 shown in FIG. 8 is formed by punching, pressing, and bending a metal plate. The annular contact portion 20 surrounding the protruding contact portion 14 of the first signal contact member 16 and the protruding contact portion 17 of the second signal contact member 19 forms a rectangular annular body. A plurality of ground joint portions 21 extend in a bent manner from the annular contact portion 20. The plurality of ground joint portions 21 are connected to ground terminals disposed on the part mount surface 11*a* of the circuit board 11. Further, a conductive partition member 23 extends from a part of the annular contact portion 20 to be bent inward of the rectangular annular body formed by the annular contact portion 20, and divides the rectangular annular body into two parts. The conductive partition member 23 is integrally formed with the ground contact member 22 as part of the annular contact portion 20.

As shown in FIGS. 5 and 6, an engaging connect portion 23*a* with which the engaging connect portion 41*a* on the flat partition 41 of the coaxial connector device 30 is engaged is provided at one end portion of the conductive partition member 23. Further, as shown in FIG. 7, in the conductive partition member 23, a board joint portion 23*b* is provided at the other end portion opposite to the one end portion where the engaging connect portion 23*a* is provided. The board joint portion 23*b* extends through the insulating body 13 through a through hole 24 provided in the insulating body 13. The board joint portion 23*b* is jointed to a ground terminal disposed on the parts mount surface 11*a* of the circuit board 11.

In the board side coaxial connector device 10 described above, the conductive partition member 23 is integrally formed with the ground contact member 22, but in the coaxial connector device, the conductive partition member 23 is not necessarily integrally formed with the ground contact member 22. The conductive partition member 23 may be configured separately from the ground contact member 22. In this case, the board joint portion 23*b* is provided in the conductive partition member 23, the board joint portion 23*b* extends through the insulating body 13 through the through hole 24 provided in the insulating body 13, and the board joint portion 23*b* is jointed to the ground terminal disposed on the parts mount surface 11*a* of the circuit board 11, thereby easily applying the ground potential from the circuit board 11 to the conductive partition member 23 and firmly installing the conductive partition member 23 on the circuit board 11 via the insulating body 13. As in the board side coaxial connector device 10 described above, when the conductive partition member 23 is formed integrally with the ground contact member 22, the number of components can be reduced to simplify the configuration, and the conductive partition member 23 can be firmly disposed in the insulating body 13.

When the coaxial connector device 30 and the board side coaxial connector device 10 are actually used, for example, as shown in FIG. 9, the board side coaxial connector device 10 is fixed to the circuit board 11 so that the insulating body 13 is disposed on the parts mount surface 11*a* of the circuit board 11, that is, on the surface of the circuit board 11. The coaxial connector device 30 to which the first coaxial cable 31A and the second coaxial cable 31B are connected is arranged opposite to the board side coaxial connector device 10 fixed to the circuit board 11. In this case, the first signal contact member 33A and the second signal contact member 33B of the coaxial connector device 30 are disposed at positions corresponding to the protruding contact portion 14 of the first signal contact member 16 and the protruding contact portion 17 of the second signal contact member 19 of the board side coaxial connector device 10, respectively, and the annular fitting portion 39 of the ground contact member 35 of the coaxial connector device 30 is disposed at a position corresponding to the annular contact portion 20 of the ground contact member 22 of the board side coaxial connector device 10.

Subsequently, the coaxial connector device 30 to which the first coaxial cable 31A and the second coaxial cable 31B are connected is displaced toward the board side coaxial connector device 10 fixed to the circuit board 11, and is fitted and connected to the board side coaxial connector device 10 as shown in FIG. 10. At this time, the first signal contact member 33A to which the central conductor 32A of the first coaxial cable 31A of the coaxial connector device 30 is connected and the second signal contact member 33B to which the central conductor 32B of the second coaxial cable 31B is connected are respectively in contact with the protruding contact portion 14 of the first signal contact member 16 and the protruding contact portion 17 of the third signal contact member 19 of the board side coaxial connector device 10. At the same time, in the coaxial connector device 30, the annular fitting portion 39 of the ground contact member 35 connected to each of the outer conductor 34A of the first coaxial cable 31A and the outer conductor 34B of the second coaxial cable 31B is connected to the annular contact portion 20 of the ground contact member 22 of the board side coaxial connector device 10 by fitting contact. That is, the ground contact member 35 comes into contact with the annular contact portion 20. Accordingly, the first coaxial cable 31A and the second coaxial cable 31B are connected to the circuit board 11 through the coaxial connector device 30 and the board side coaxial connector device 10, respectively.

Figure 11:
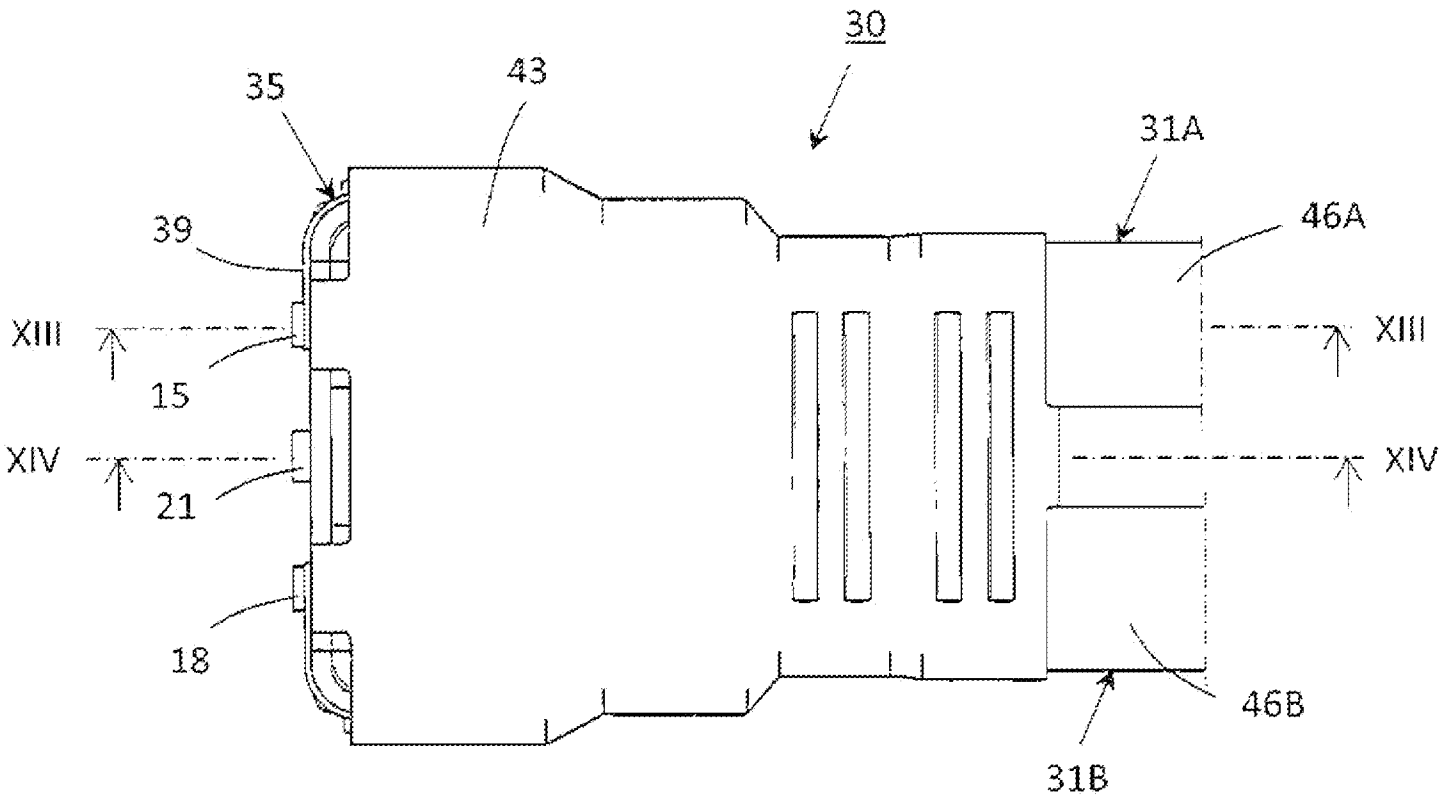
FIG. 11 is a plan view showing a state in which the example of the coaxial connector device to which the first and second coaxial cables are connected is fitted and connected to the example of the mate coaxial connector device.
Figure 12:
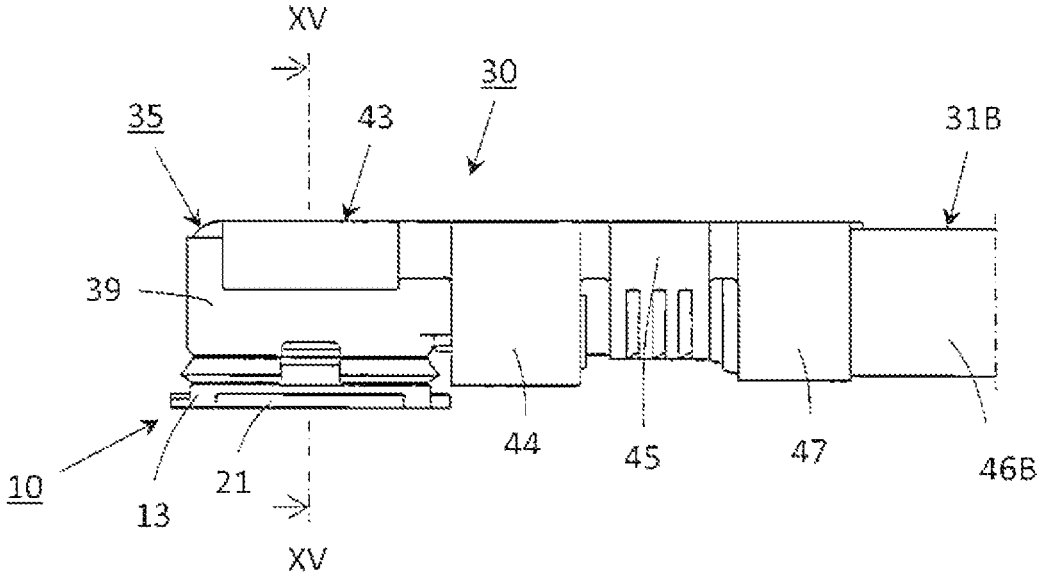
FIG. 12 is a side view showing a state in which the example of the coaxial connector device to which the first and second coaxial cables are connected is fitted and connected to the example of the mate coaxial connector device.

FIG. 11 (plan view) and FIG. 12 (side view) show a state in which the coaxial connector device 30 to which the first coaxial cable 31A and the second coaxial cable 31B are connected is fitted and connected to the board side coaxial connector device 10, with the circuit board 11 omitted. When the coaxial connector device 30 is fitted and connected to the board side coaxial connector device 10, as shown in FIG. 13, which is a cross-sectional view taken along line XIII-XIII in FIG. 11, in the coaxial connector device 30, the central conductor 32A of the first coaxial cable 31A is sandwiched by the first signal contact member 33A pressed by the bending contact portion 40A provided in the insulating housing 40, thereby being connected to the first signal contact member 33A. The outer conductor 34A of the first coaxial cable 31A is connected to the cable support 42A and the shell portion 43 provided in the annular fitting portion 39 of the ground contact member 35. Although not shown, in the coaxial connector device 30, the second coaxial cable 31B is also connected to the second signal contact member 33B by the central conductor 32B being sandwiched by the second signal contact member 33B pressed by the bending contact portion 40B provided in the insulating housing 36, similarly to the first coaxial cable 31A. The outer conductor 34B of the second coaxial cable 31B is connected to the cable support 42B and the shell portion 43 provided in the annular fitting portion 39 of the ground contact member 35.

Figure 15:
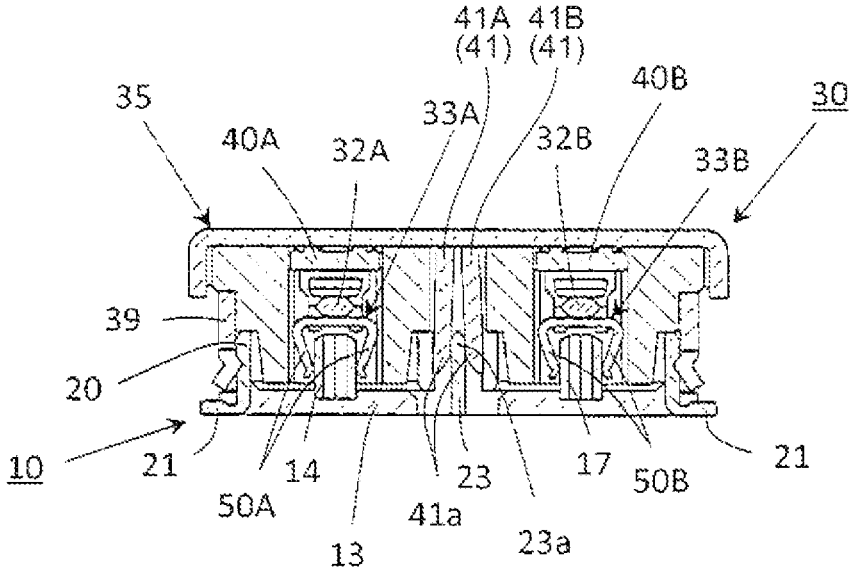
FIG. 15 is a cross-sectional view taken along line XV-XV in FIG. 12.

In addition to FIG. 13 described above, as shown in FIG. 15, which is a cross-sectional view taken along line XV-XV in FIG. 12, a pair of mutually facing contact parts 50A provided on the first signal contact member 33A are in contact with the protruding contact portion 14 of the first signal contact member 16 of the board side coaxial connector device 10 by sandwiching the protruding contact portion 14. In addition, a pair of mutually facing contact parts 50B provided on the second signal contact member 33B are in contact with the protruding contact portion 17 of the second signal contact member 19 of the board side coaxial connector device 10 by sandwiching the protruding contact portion 17. The annular fitting portion 39 of the ground contact member 35 is in contact with the annular contact portion 20 of the ground contact member 22 of the board side coaxial connector device 10.

Figure 14:
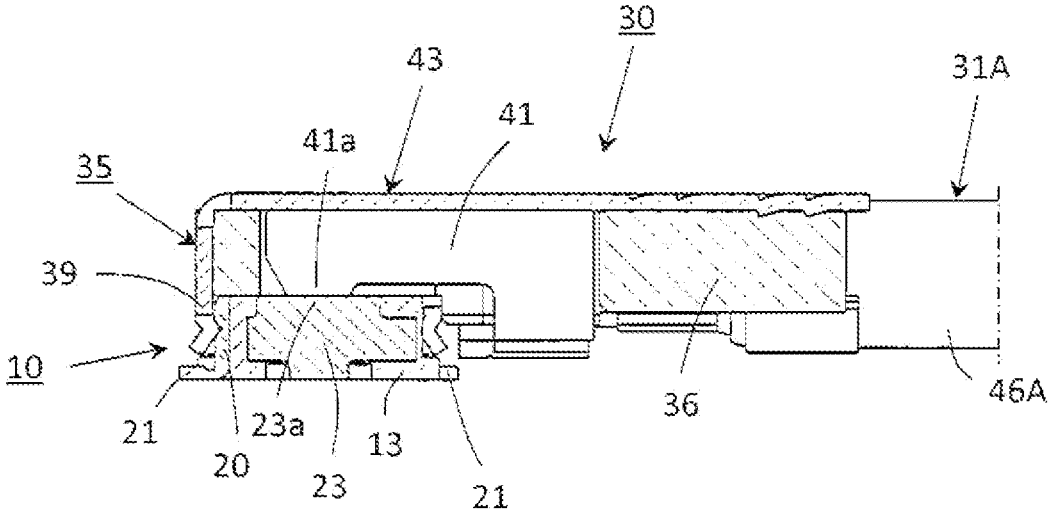
FIG. 14 is a cross-sectional view taken along line XIV-XIV in FIG. 11.

Further, as shown in FIG. 14, which is a cross-sectional view taken along line XIV-XIV in FIG. 11, the engaging connect portion 41*a* provided on the flat partition 41 provided on the annular fitting portion 39 of the ground contact member 35 of the coaxial connector device 30 is in contact with and engaged with the engaging connect portion 23*a* provided on the conductive partition member 23 of the board side coaxial connector device 10. Accordingly, the conductive partition member 23 of the board side coaxial connector device 10 and the flat partition 41 of the coaxial connector device 30 are engaged with each other in a state where a ground potential is provided. The flat partition 41 is in contact with the conductive partition member 23 in when the annular fitting portion 39 is fitted to the annular contact portion 20. The conductive partition member 23 may be inserted between the first partition 41A and the second partition 41B when the annular fitting portion 39 is fitted to the annular contact portion 20. The annular fitting portion 39 may be configured to fit outside the annular contact portion 20. The flat partition 41 may be spaced apart from the wall portion 39A. The annular contact portion 20 may be disposed between the flat partition 41 and the wall portion 39A in a state when the annular fitting portion 39 is fitted to the annular contact portion 20.

Figure 16:
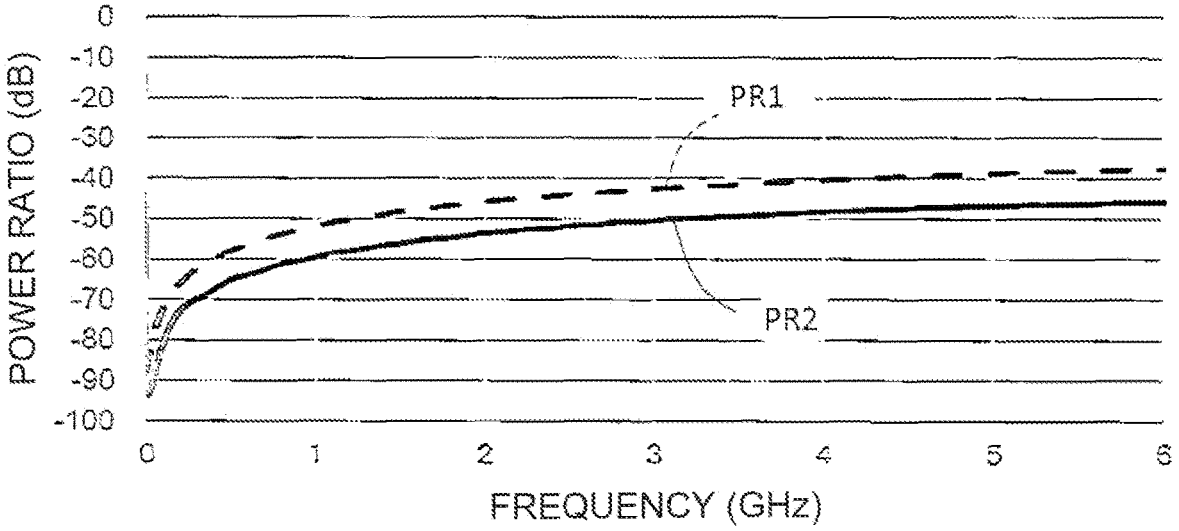
FIG. 16 is a graph showing an experimental result of a signal transmission state when the example of the coaxial connector device is fitted and connected to the mate coaxial connector device.

FIG. 16 shows an experimental result in a state where the coaxial connector device 30 in which the first coaxial cable 31A and the second coaxial cable 31B are connected is fitted and connected to the board side coaxial connector device 10 attached to the circuit board 11 as shown in FIG. 10. In this experiment, when the test signal St is input to the signal joint portion 15 provided in the first signal contact member 16 of the board side coaxial connector device 10, the power ratio of the test signal St output to the signal joint portion 18 provided in the second signal contact member 19 of the board side coaxial connector device 10 to the input test signal St is obtained. In the graph shown in FIG. 16, the horizontal axis represents the frequency (GHz) of the test signal St, the vertical axis represents the power ratio (dB), the dashed curve PR1 represents the power ratio obtained in the configuration in which the coaxial connector device 30 does not include the flat partition 41, and the solid curve PR2 represents the power ratio obtained in the configuration in which the coaxial connector device 30 includes the flat partition 41.

As is clear from the experimental results shown in FIG. 16, the power ratio represented by the solid curve PR2 which is the power ratio obtained in the configuration in which the coaxial connector device 30 includes the flat partition 41 is lower than the power ratio represented by the dashed curve PR1 which is the power ratio obtained in the configuration in which the coaxial connector device 30 does not include the flat partition 41 over the entire frequency range up to the frequency of 6 GHz for the test signal St. This indicates that the flat partition 41 included in the coaxial connector device 30 suppresses crosstalk noise propagating from the test signal St transmitted through the first signal contact member 33A of the coaxial connector device 30 to the second signal contact member 33B of the coaxial connector device 30.

According to the coaxial connector device 30 described above constituting an example of the coaxial connector device, the first signal contact member 33A and the second signal contact member 33B disposed inside the annular fitting portion 39 of the ground contact member 35 are disposed close to each other with a small gap. Accordingly, an area occupied by the coaxial connector device 30 in the parts mount surface 11*a* of the circuit board 11 to which the board side coaxial connector device 10 to which the coaxial connector device 30 is fitted and connected is attached may be reduced.

In addition, the first signal contact member 33A and the second signal contact member 33B are electromagnetically shielded from each other by the flat partition 41 provided with the ground potential, because the flat partition 41 provided with the ground potential is disposed in the small gap between the first signal contact member 33A and the second signal contact member 33B. Accordingly, the radio frequency signal transmitted through the first signal contact member 33A is less likely to be mixed as crosstalk noise into the radio frequency signal transmitted through the second signal contact member 33B, and the radio frequency signal transmitted through the second signal contact member 33B is less likely to be mixed as crosstalk noise into the radio frequency signal transmitted through the first signal contact member 33A. As a result, deterioration in the transmission characteristics of the radio frequency signals transmitted through the first signal contact member 33A and the second signal contact member 33B may be prevented.

In the coaxial connector device 30, the flat partition 41 is integrally formed with the ground contact member 35 so as to extend from a portion of the annular fitting portion 39 of the ground contact member 35. Therefore, the number of components can be reduced, the configuration can be simplified, and the flat partition 41 can be firmly arranged in the insulating housing 36.

Although certain procedures or operations are described herein as being performed sequentially or in a particular order, in some examples one or more of the operations may be performed in a different order, in parallel, simultaneously with each other, or in an overlapping manner. Additionally, in some examples, one or more of the operations may be optionally performed or, in some cases, omitted altogether.

We claim all modifications and variations coining within the spirit and scope of the subject matter claimed herein.

Industrial Applicability

The coaxial connector device as described above can reduce the area occupied by the coaxial connector device on the parts mount surface of the circuit board when two coaxial cables are fitted and connected to a mate coaxial connector device which is a board side coaxial connector device attached to the parts mount surface of the circuit board in a connected state. In addition, deterioration in the transmission characteristics of the radio frequency signal transmitted through the coaxial connector device may be prevented. The coaxial connector device can be widely applied to various electronic devices.

What is claimed is:

1. A coaxial connector device, comprising:

a first signal contact member to which a central conductor of a first coaxial cable is electrically connected, configured to come into contact with and be connected to a first mate signal contact member of a mate coaxial connector device;

a second signal contact member, to which a central conductor of a second coaxial cable is electrically connected, configured to come into contact with and be connected to a second mate signal contact member of the mate coaxial connector device;

a ground contact member comprising:

an annular fitting portion disposed around the first and second signal contact members to fit a mate ground contact member of the mate coaxial connector device; and a shell portion extending bendably from the annular fitting portion to be electrically connected to an outer conductor of each of the first and second coaxial cables;

an insulating housing supporting the first signal contact member, the second signal contact member, and the ground contact member in an isolated state; and a flat partition provided with a ground potential, held by the insulating housing and located between the first signal contact member and the second signal contact member, wherein the flat partition is integrally formed with the ground contact member and extends from a portion of the annular fitting portion of the ground contact member into an annulus formed by the annular fitting portion.

2. The coaxial connector device according to claim 1, wherein the flat partition is engaged with a mate conductive partition member of the mate coaxial connector device provided with a ground potential and disposed between the first mate signal contact member and the second mate signal contact member.

3. A connector for connecting a first cable and a second cable to a mate connector having a mate first signal contact, a mate second signal contact, and a mate conductive surrounding portion surrounding at least a portion of the mate first signal contact and at least a portion of the mate second signal contact, the connector comprising:

a first signal contact configured to be joined to a first signal conductor of the first cable and to be in contact with the mate first signal contact to transmit a first signal;

a second signal contact configured to be joined to a second signal conductor of the second cable and to be in contact with the mate second signal contact to transmit a second signal;

a conductive surrounding portion surrounding at least a portion of the first signal contact and at least a portion of the second signal contact, the conductive surrounding portion configured to fit to the mate conductive surrounding portion; and a conductive partition electrically connected to the conductive surrounding portion and partitioning an inner area of the conductive surrounding portion into a first region in which at least a portion of the first signal contact is disposed and a second region in which at least a portion of the second signal contact is disposed, wherein the connector is configured to transmit only one signal in the first region at any point in time, including the first signal, and wherein the connector is configured to transmit only one signal in the second region at any point in time, including the second signal.

4. The connector according to claim 3, wherein the first signal contact is the only signal contact located in the first region, and the second signal contact is the only signal contact located in the second region.

5. The connector according to claim 3, wherein the conductive partition is integrally formed with the conductive surrounding portion.

6. The connector according to claim 5, wherein the conductive surrounding portion comprises a first portion and a second portion facing each other, wherein both the first region and the second region are located between the first portion and the second portion, and wherein the conductive partition extends from the first portion toward the second portion.

7. The connector according to claim 3, wherein the mate connector further comprises a mate conductive partition that partitions an inner area of the mate conductive surrounding portion into a mate first region and a mate second region, wherein at least a part of the mate first signal contact is disposed in the mate first region, wherein at least a part of the mate second signal contact is disposed in the mate second region, and wherein the conductive partition is in contact with the mate conductive partition when the conductive surrounding portion is fitted to the mate conductive partition.

8. The connector according to claim 7, further comprising an insulating housing that holds: the first signal contact; the second signal contact; the conductive surrounding portion; and the conductive partition, wherein the conductive partition penetrates the insulating housing.

9. The connector according to claim 8, wherein the mate connector further comprises a mate conductive partition that partitions an inner area of the mate conductive surrounding portion into a mate first region and a mate second region, wherein at least a portion of the mate first signal contact is disposed in the mate first region and at least a portion of the mate second signal contact is disposed in the mate second region, and wherein the insulating housing comprises:

a first insulating portion disposed in the mate first region when the conductive surrounding portion is fitted to the mate conductive surrounding portion, and a second insulating portion disposed in the mate second region when the conductive surrounding portion is fitted to the mate conductive surrounding portion.

10. The connector according to claim 3, wherein the first cable is a coaxial cable having the first signal conductor and a first outer conductor surrounding the first signal conductor, wherein the second cable is a coaxial cable having the second signal conductor and a second outer conductor surrounding the second signal conductor, and wherein the connector further comprises a shell portion outside the conductive surrounding portion and joined to the first outer conductor and the second outer conductor.

11. The connector according to claim 10, wherein the first cable further has an insulating first sheath surrounding the first outer conductor, wherein the second cable further has an insulating second sheath surrounding the second outer conductor, and wherein the shell portion comprises:

a first sheath holder configured to hold the first cable from outside the first sheath;

a first outer conductor holder configured to be electrically joined to the exposed first outer conductor between the first sheath holder and the conductive surrounding portion;

a second sheath holder configured to hold the second cable from outside the second sheath; and a second outer conductor holder configured to be electrically joined to the exposed second outer conductor between the second sheath holder and the conductive surrounding portion.

12. The connector according to claim 11, wherein the shell portion further comprises a base portion extending outward from the conductive surrounding portion, wherein the first sheath holder is configured to hold the first cable with the first cable located between the first sheath holder and the base portion, wherein the first outer conductor holder is configured to hold the first cable with the first cable located between the first outer conductor holder and the base portion, wherein the second sheath holder is configured to hold the second cable with the second cable located between the second sheath holder and the base portion, and wherein the second outer conductor holder is configured to hold the second cable with the second cable located between the second outer conductor holder and the base portion.

13. The connector according to claim 12, further comprising a conductive cover closing one end of the conductive surrounding portion, wherein the base portion is integrally formed with the conductive cover.

14. The connector according to claim 13, wherein the conductive surrounding portion comprises: a wall portion substantially perpendicular to the conductive cover; and a facing portion that faces the conductive cover, wherein both the first region and the second region are located between the wall portion and the facing portion.

15. The connector according to claim 14, wherein the conductive partition extends from the facing portion toward the conductive cover, and extends from the facing portion toward the wall portion.

16. The connector according to claim 15, wherein the facing portion comprises: a first facing portion that faces the conductive cover with the first cable located between the first facing portion and the conductive cover; and a second facing portion that faces the conductive cover with the second cable located between the second facing portion and the conductive cover, and wherein the conductive partition comprises:

a first partition that extends from the first facing portion toward the conductive cover and extends from the first facing portion toward the wall portion; and a second partition that extends from the second facing portion toward the conductive cover and extends from the second facing portion toward the wall portion overlapping the first partition.

17. The connector according to claim 16, wherein the mate connector further comprises a mate conductive partition that partitions an inner area of the mate conductive surrounding portion into a mate first region and a mate second region, wherein at least a part of the mate first signal contact is disposed in the mate first region and at least a part of the mate second signal contact is disposed in the mate second region, and wherein the mate conductive partition is inserted between the first partition and the second partition when the conductive surrounding portion is fitted to the mate conductive surrounding portion.

18. The connector according to claim 15, wherein the conductive surrounding portion is configured to fit outside the mate conductive surrounding portion, wherein the conductive partition is spaced apart from the wall portion, and wherein the mate conductive surrounding portion is disposed between the conductive partition and the wall portion when the conductive surrounding portion is fitted to the mate conductive surrounding portion.

* * * * *